US010202223B2

(12) United States Patent
Ahmed

(10) Patent No.: US 10,202,223 B2
(45) Date of Patent: Feb. 12, 2019

(54) MULTI-PURPOSE CAP FOR TUBE DISPENSER

(71) Applicant: UNITED ARAB EMIRATES UNIVERSITY, Al Ain (AE)

(72) Inventor: Waleed K. Ahmed, Al Ain (AE)

(73) Assignee: United Arab Emirates University, Al-Ain (AE)

( * ) Notice: Subject to any disclaimer, the term of this patent is extended or adjusted under 35 U.S.C. 154(b) by 0 days.

(21) Appl. No.: 15/639,855

(22) Filed: Jun. 30, 2017

(65) Prior Publication Data

US 2019/0002163 A1 Jan. 3, 2019

(51) Int. Cl.
*B65D 35/28* (2006.01)
*B65D 35/44* (2006.01)

(52) U.S. Cl.
CPC ..... *B65D 35/28* (2013.01); *B65D 35/44* (2013.01)

(58) Field of Classification Search
CPC ..... B65D 35/24; B65D 35/28; B65D 35/44; B65D 51/249; B65D 51/24; B65D 51/243; B65D 51/32
See application file for complete search history.

(56) References Cited

U.S. PATENT DOCUMENTS 1,466,043 A * 8/1923 Graham ..... B65D 35/40 222/106
D63,368 S * 11/1923 Johnson ..... D9/442
1,706,815 A * 3/1929 Phillipson ..... B65D 51/246 141/381
1,731,703 A * 10/1929 Bourke ..... B65D 35/18 141/360
1,892,140 A * 12/1932 Fogler ..... B65D 51/249 222/105
1,908,847 A * 5/1933 Hubbell ..... B65D 47/2018 222/494
2,078,149 A * 4/1937 Lutz ..... B65D 51/249 222/105
2,084,568 A * 6/1937 White ..... B65D 41/0442 220/288
D120,353 S * 5/1940 Osterhoudt ..... D9/442
(Continued)

FOREIGN PATENT DOCUMENTS

KR 20120074347 7/2012
WO WO 2015076810 * 5/2015

*Primary Examiner* — Paul R Durand
*Assistant Examiner* — Randall Gruby
(74) *Attorney, Agent, or Firm* — Richard C. Litman

(57) ABSTRACT

The multi-purpose cap for a tube dispenser includes a cap for sealing an open end of a squeezable tube dispenser. The multi-purpose cap is formed as a hollow body having a closed upper end and an open lower end. A cylindrical retaining member is mounted, substantially centrally, to a lower face of the closed upper end within the hollow body. The cylindrical retaining member is adapted for releasably receiving and sealing a spout of a squeezable tube dispenser. The multi-purpose cap can have a first sidewall having a flat planar contour and a second sidewall having an arcuate contour. The flat, planar first sidewall of the hollow body is adapted for pressing against the squeezable tube dispenser to selectively manually manipulate contents thereof. Alternatively, the multi-purpose cap can have a substantially cylindrical sidewall and a squeezing member attached to an exterior surface thereof.

8 Claims, 6 Drawing Sheets

(56) References Cited

U.S. PATENT DOCUMENTS 2,321,333 A * 6/1943 Terry ..... B65D 51/223 220/278
2,646,704 A * 7/1953 Reider ..... B65D 51/24 81/3.09
3,292,807 A * 12/1966 Golde ..... B65D 41/185 215/253
3,586,212 A * 6/1971 Tzouras ..... B65D 35/24 222/93
4,470,521 A * 9/1984 Scammell ..... B29C 45/0046 222/107
4,565,303 A * 1/1986 Gilbertson ..... B65D 35/28 222/103
4,724,615 A * 2/1988 Mackles ..... A47G 21/04 222/192
4,801,054 A * 1/1989 Nycz ..... B65D 47/0838 215/235
4,827,951 A * 5/1989 Grussmark ..... A61C 15/043 132/314
4,846,360 A * 7/1989 Criste ..... B65D 51/243 215/226
5,145,093 A * 9/1992 Zeller ..... B65D 35/28 222/103
D349,449 S * 8/1994 Linner ..... D9/442
5,531,349 A * 7/1996 Wojcik ..... B65D 47/0814 215/237
5,556,008 A * 9/1996 Silver ..... A61J 7/0023 215/DIG. 5
5,782,385 A * 7/1998 Soon ..... B65D 35/28 222/103
D412,597 S * 8/1999 Bauer ..... D28/20
5,979,706 A * 11/1999 Grussmark ..... A61C 15/043 222/105
6,071,523 A * 6/2000 Mehta ..... A61J 7/0023 141/114
6,102,254 A * 8/2000 Ross ..... A61J 7/0023 141/114
6,155,458 A * 12/2000 Picard ..... B65D 35/28 222/103
D438,787 S * 3/2001 Heeter ..... D9/697
6,675,482 B1 * 1/2004 Gilbert, Jr. ..... A61J 7/0023 222/258
6,880,730 B2 * 4/2005 Fulwood ..... B65D 51/249 222/186
D539,141 S * 3/2007 Penfold ..... D9/442
7,374,046 B1 * 5/2008 O'Brien ..... A45C 11/20 206/216
D577,287 S * 9/2008 Haltom, III ..... D9/436
7,717,284 B2 * 5/2010 Giusti ..... B01L 3/50825 215/305
8,006,709 B1 * 8/2011 Ebnayamin ..... A61C 15/043 132/325
9,120,602 B2 * 9/2015 Lagace ..... B65D 51/249
D780,577 S * 3/2017 Seiders ..... D7/392.1
9,833,809 B2 * 12/2017 Feddes ..... B65D 47/42
9,834,349 B1 * 12/2017 Gallagher ..... B65D 51/242
2004/0040981 A1 * 3/2004 Hafeez ..... B65D 35/28 222/103
2005/0269358 A1 * 12/2005 Choi ..... B65D 35/28 222/103
2006/0191936 A1 * 8/2006 De Laforcade ..... B65D 51/223 220/278
2011/0186597 A1 * 8/2011 Schaefer ..... B67D 7/06 222/106
2012/0187147 A1 * 7/2012 Lightfoot ..... B65D 35/28 222/103
2015/0284172 A1 * 10/2015 Wan ..... B65B 69/005 222/95
2016/0167834 A1 * 6/2016 Beckerman ..... B65D 35/36 222/93
2016/0304249 A1 * 10/2016 Beckerman ..... B65D 35/24

* cited by examiner

MULTI-PURPOSE CAP FOR TUBE DISPENSER

BACKGROUND OF THE INVENTION

1. Field of the Invention

The present invention relates to packaging and dispensing, and particularly, to a multi-purpose cap for a squeezable tube dispenser, such as industrial paste tubes, medical paste tubes, chemical paste tubes, toothpaste tubes and the like.

2. Description of the Related Art

Squeezable, tube-type dispensers are used for containing and dispensing numerous materials, such as toothpaste, medical and chemical pastes, adhesives, hair products, gels, and caulk, for example. The basic structure of such squeezable tubes includes an elongated, typically cylindrical hollow tube, formed of a flexible material, with one closed end and one end having a neck or spout for dispensing. The neck or spout is usually cylindrical and typically defines a circular bore for dispensing of the material. The closed end of the tube is a generally flat and sealed. A closure of the spout is provided by a removable cap, typically through the use of cooperating threads or a snap-fit apparatus.

The use of squeezable tubes is deceptively simple, in that the contents are dispensed by removing the cap and squeezing the tube portion with sufficient force to extrude the contents outwardly through the spout. As the contents are dispensed, the tube tends to flatten. Despite the basic simplicity of the use of squeezable tube dispensers, problems still arise as the material within the tube is dispensed. The flattening of the tube is not controlled and thus simply flattens wherever it is squeezed. Repeated dispensing of the material in the tube results in unevenly distributed contents throughout the ever-flattening tube. As a result, the user must periodically, if not continuously, manipulate the tube to flatten the partially filled tube from the closed end bottom toward the head end. This process is necessary to avoid undesired waste and uneven distribution of the material within the tube. Failure to flatten the tube from the bottom can make it difficult to empty the tube completely.

Although a wide variety of squeezing tools exist to alleviate this problem, such tools are often overly complex, burdensome to use, or may be easily lost, since they are stored separately from the squeezable tube dispenser. Further, such squeezing tools typically do not address the issue of stability of the tube; i.e., prevention of movement of the tube on a flat surface, such as a countertop, during squeezing. Thus, a multi-purpose cap for a tube dispenser solving the aforementioned problems is desired.

SUMMARY OF THE INVENTION

The multi-purpose cap for a tube dispenser can be used to detachably cover the open end of a squeezable tube dispenser, such as those typically associated with toothpaste, industrial pastes, medical and chemical pastes, adhesives, hair products, gels, caulk and the like. The multi-purpose cap is formed as a hollow body having a closed upper end, an open lower end, and at least one sidewall extending between the upper end and the lower end. According to an embodiment, the cap can include a first sidewall having a flat, planar contour and a second sidewall having an arcuate contour. Preferably, the second sidewall has a substantially constant radius of curvature; i.e., the cross-sectional contour forms a circular section, similar to a conventional tube cap. The closed upper end may have a flat planar contour, also similar to a conventional tube cap.

A cylindrical retaining member is mounted, substantially centrally, to a lower face of the closed upper end within the hollow body. The cylindrical retaining member is adapted for releasably receiving and sealing a spout of a squeezable tube dispenser, similar to a conventional tube dispenser cap. The cylindrical retaining member may be threaded on an inner face thereof, for receiving a threaded spout, or may be adapted for releasable frictional engagement with the spout, dependent upon the particular type of tube dispenser. The flat, planar first sidewall of the hollow body is adapted for pressing against the squeezable tube dispenser to selectively manipulate contents thereof.

In an alternative embodiment, the multi-purpose cap for a tube dispenser includes a hollow body having a closed upper end, an open lower end, and a substantially cylindrical sidewall. A cylindrical retaining member is mounted to a lower face of the closed upper end within the hollow body, substantially centrally with respect to the closed upper end, similar to the previous embodiment. A squeezing member is secured to an exterior surface of the substantially cylindrical sidewall of the hollow body, adjacent the closed upper end thereof. As in the previous embodiment, the cylindrical retaining member is adapted for releasably receiving and sealing a spout of a squeezable tube dispenser. The squeezing member is adapted for pressing against the squeezable tube dispenser to selectively manipulate contents thereof. The squeezing member may have any suitable contouring and relative dimensions. For example, the squeezing member may be in the form of an elongated rod extending substantially tangentially with respect to the substantially cylindrical sidewall (i.e., extending orthogonal to the radius of the hollow body).

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
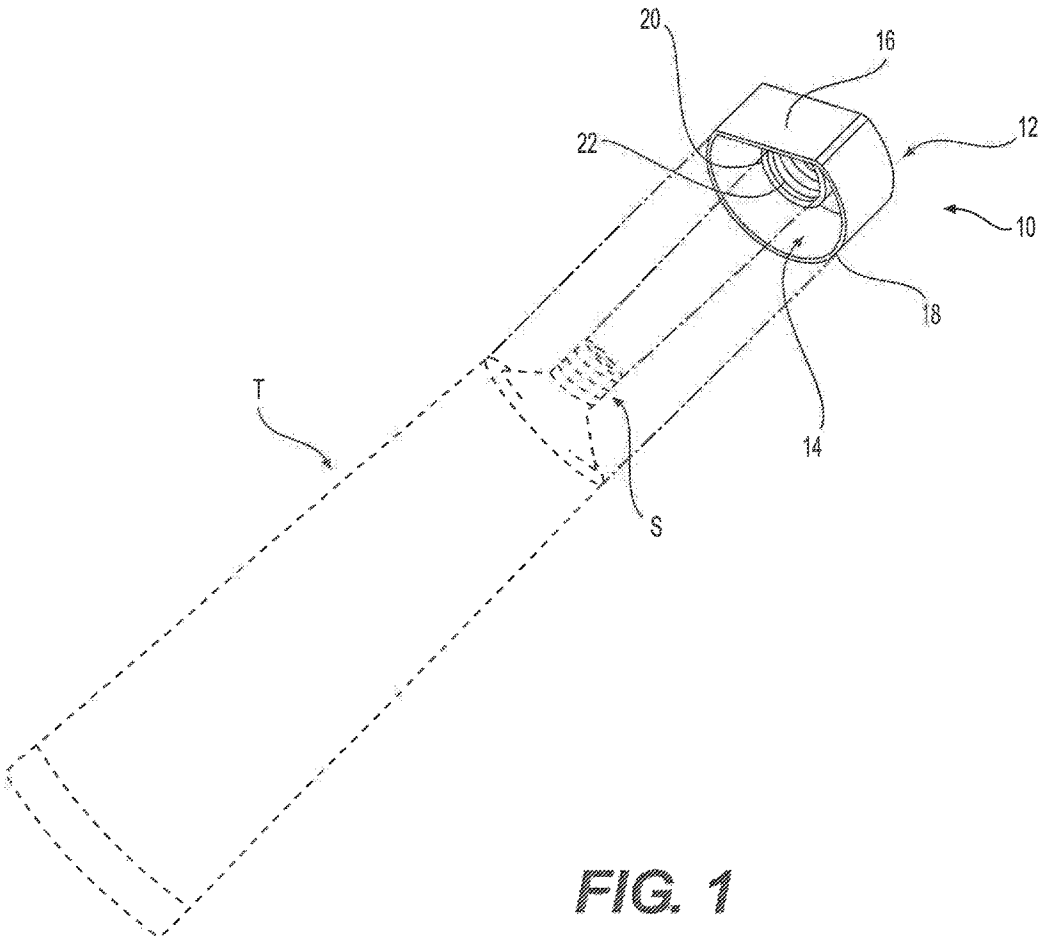
FIG. 1 is an environmental perspective view of an multi-purpose cap for a tube dispenser according to the present invention.
Figure 2:
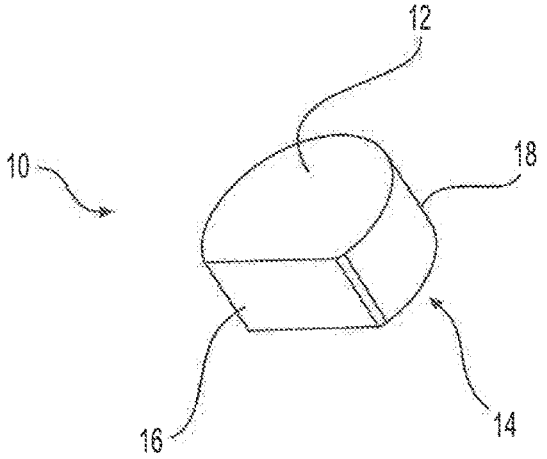
FIG. 2 is an upper perspective view of a first embodiment of the multi-purpose cap for a tube dispenser according to the present invention.
Figure 3:
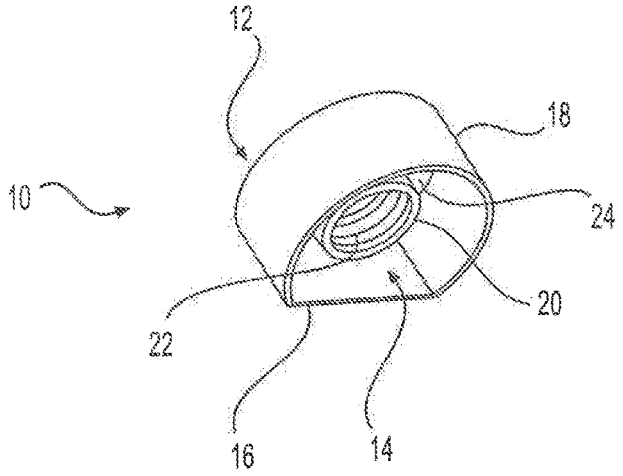
FIG. 3 is a lower perspective view of a first embodiment of the multi-purpose cap for a tube dispenser according to the present invention.

The multi-purpose cap for a tube dispenser 10 can be used to detachably cover the open end of a conventional, squeezable tube dispenser, such as those typically associated with toothpaste, industrial pastes, medical and chemical pastes, adhesives, hair products, gels, caulk and the like. It should be understood that exemplary tube T, including a dispensing spout S, shown in FIG. 1 is shown for exemplary purposes only. As shown in FIGS. 1-3, the multi-purpose cap 10 is formed as a hollow body, which may be manufactured from any suitable material, such as hard plastic or the like, having a closed upper end 12, an open lower end 14, and at least one sidewall extending between the upper end 12 and the lower end 14. The closed upper end 12 may have a flat planar contour, also similar to a conventional tube cap. It should be understood that the relative dimensions of multi-purpose cap 10 may be varied dependent upon the particular size and type of tube to which the device 10 is being applied.

A cylindrical retaining member 20 is mounted, substantially centrally, to a lower face 24 of the closed upper end 12 within the hollow body. The cylindrical retaining member 20 is adapted for releasably receiving and sealing the spout S of the squeezable tube dispenser T, similar to a conventional tube dispenser cap. The cylindrical retaining member may have threads 22 formed on an inner face thereof, for receiving a threaded spout, or may be adapted for releasable frictional engagement with the spout, dependent upon the particular type of tube dispenser. It should be understood that the inner surface of the cylindrical retaining member 20 is similar to that of a conventional cap for a squeezable tube dispenser and may be manufactured in any suitable manner for releasably covering and sealing the dispensing spout, dependent upon the particular type of tube to which device 10 is being applied.

Figure 4:
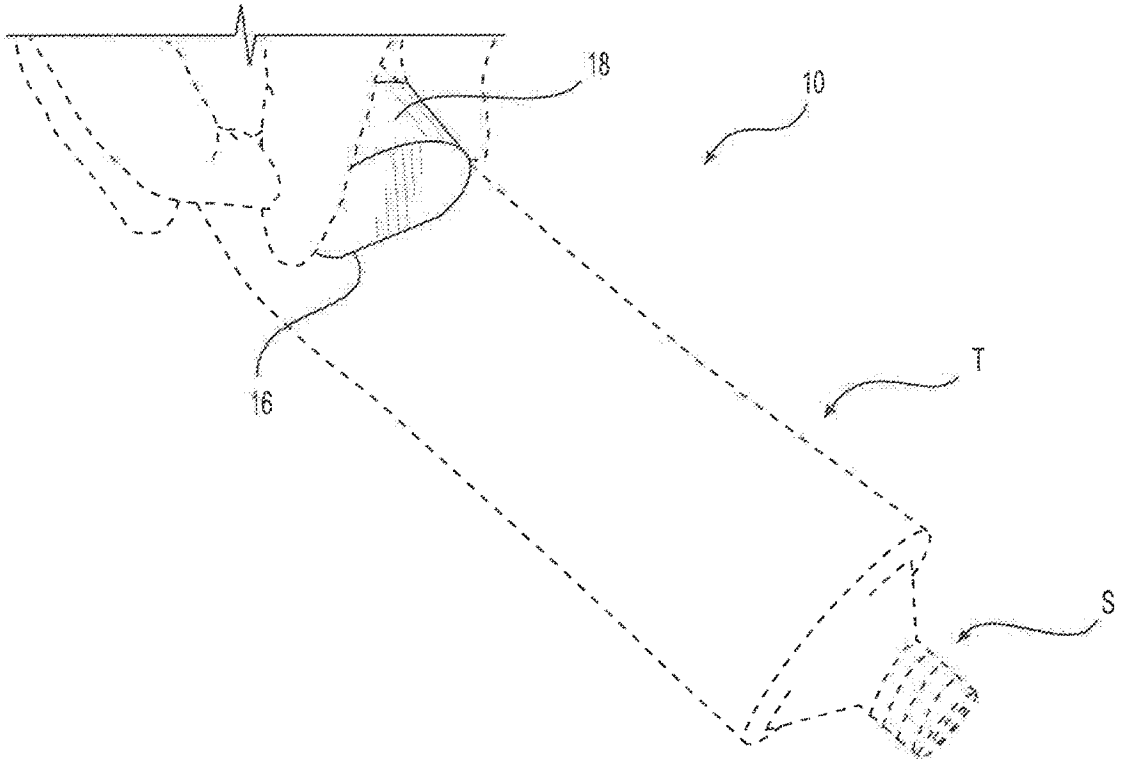
FIG. 4 is an environmental perspective view of the multi-purpose cap for a tube dispenser, shown being used for squeezing the contents of an exemplary tube dispenser.

According to an embodiment (FIGS. 1-3), the multi-purpose cap 10 can have a first sidewall 16 having a flat planar contour and a second sidewall 18 having an arcuate contour. Preferably, the second sidewall 18 has a substantially constant radius of curvature; i.e., the cross-sectional contour of second sidewall 18 forms a circular section, similar to a conventional tube cap. As shown in FIG. 4, the flat, planar first sidewall 16 of the hollow body is adapted for pressing against the squeezable tube dispenser T to selectively manipulate the contents thereof. Thus, when the user wishes to, for example, squeeze or push the contents of tube T towards spout S, the device 10 is removed from spout S, the user grips the second sidewall 18 (as shown in FIG. 4), contacts the flat, planar sidewall 16 against an exterior of tube T, and squeezes the tube T, with sidewall 16, pushing device 10 forward, toward spout S.

An alternative embodiment of the multi-purpose cap for a tube dispenser, designated 100 in FIGS. 5-8, includes a hollow body having a closed upper end 112, an open lower end 114, and a substantially cylindrical sidewall 116. Although sidewall 116 may be formed with alternative contours dependent upon the particular type of tube T to which device 100 is being applied, sidewall 116 does not include a specialized face for squeezing the tube T (unlike device 10 of FIGS. 1-4). The closed upper end 112 may have a flat planar contour, similar to a conventional tube cap. It should be understood that the relative dimensions of multi-purpose cap 100 may be varied dependent upon the particular size and type of tube to which the device 100 is being applied.

Figure 5:
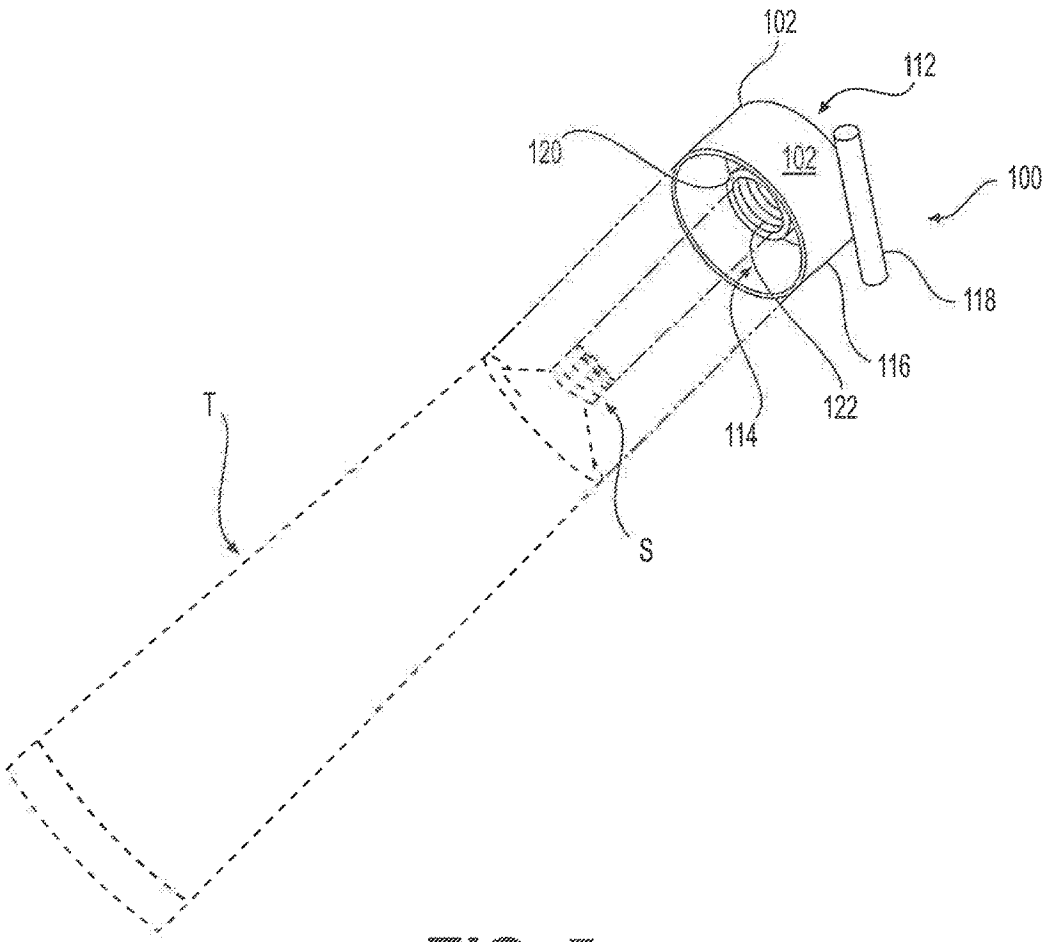
FIG. 5 is an environmental perspective view of a second embodiment of the multi-purpose cap for a tube dispenser.
Figure 6:
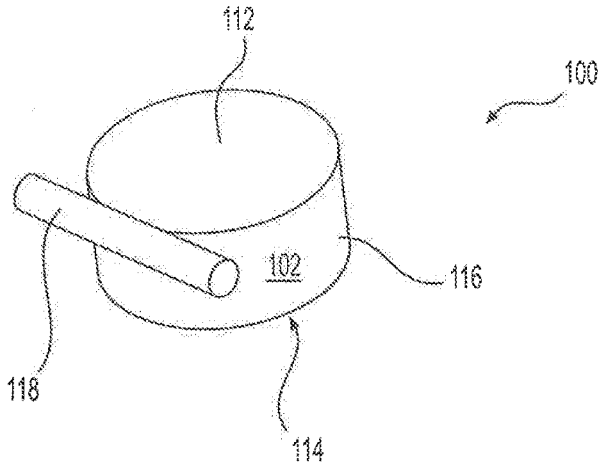
FIG. 6 is an upper perspective view of the second embodiment of the multi-purpose cap for a tube dispenser of FIG. 5.
Figure 7:
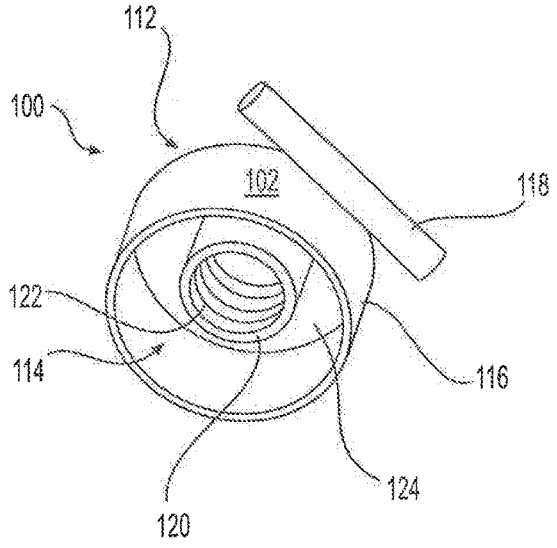
FIG. 7 is a lower perspective view of the second embodiment of the multi-purpose cap for a tube dispenser of FIG. 5.

Similar to the previous embodiment, a cylindrical retaining member 120 is mounted to a lower face 124 of the closed upper end 112 within the hollow body, substantially centrally with respect to closed upper end 112. A squeezing member 118 is secured to an exterior surface 102 of the substantially cylindrical sidewall 116, adjacent the closed upper end 112. The squeezing member 118 may have any suitable contouring and relative dimensions. For example, as best seen in FIGS. 5-7, the squeezing member 118 may be in the form of an elongated rod extending substantially tangentially with respect to the substantially cylindrical sidewall 116 (i.e., extending orthogonal to the radius of the hollow body).

As in the previous embodiment, the cylindrical retaining member 120 is adapted for releasably receiving and sealing spout S of squeezable tube dispenser T. The cylindrical retaining member 120 may have threads 122 formed on an inner face thereof, for receiving a threaded spout, or may be adapted for releasable frictional engagement with the spout, dependent upon the particular type of tube dispenser. It should be understood that the inner surface of the cylindrical retaining member 120 is similar to that of a conventional cap for a squeezable tube dispenser and may be manufactured in any suitable manner for releasably covering and sealing the dispensing spout, dependent upon the particular type of tube to which device 100 is being applied.

Figure 8:
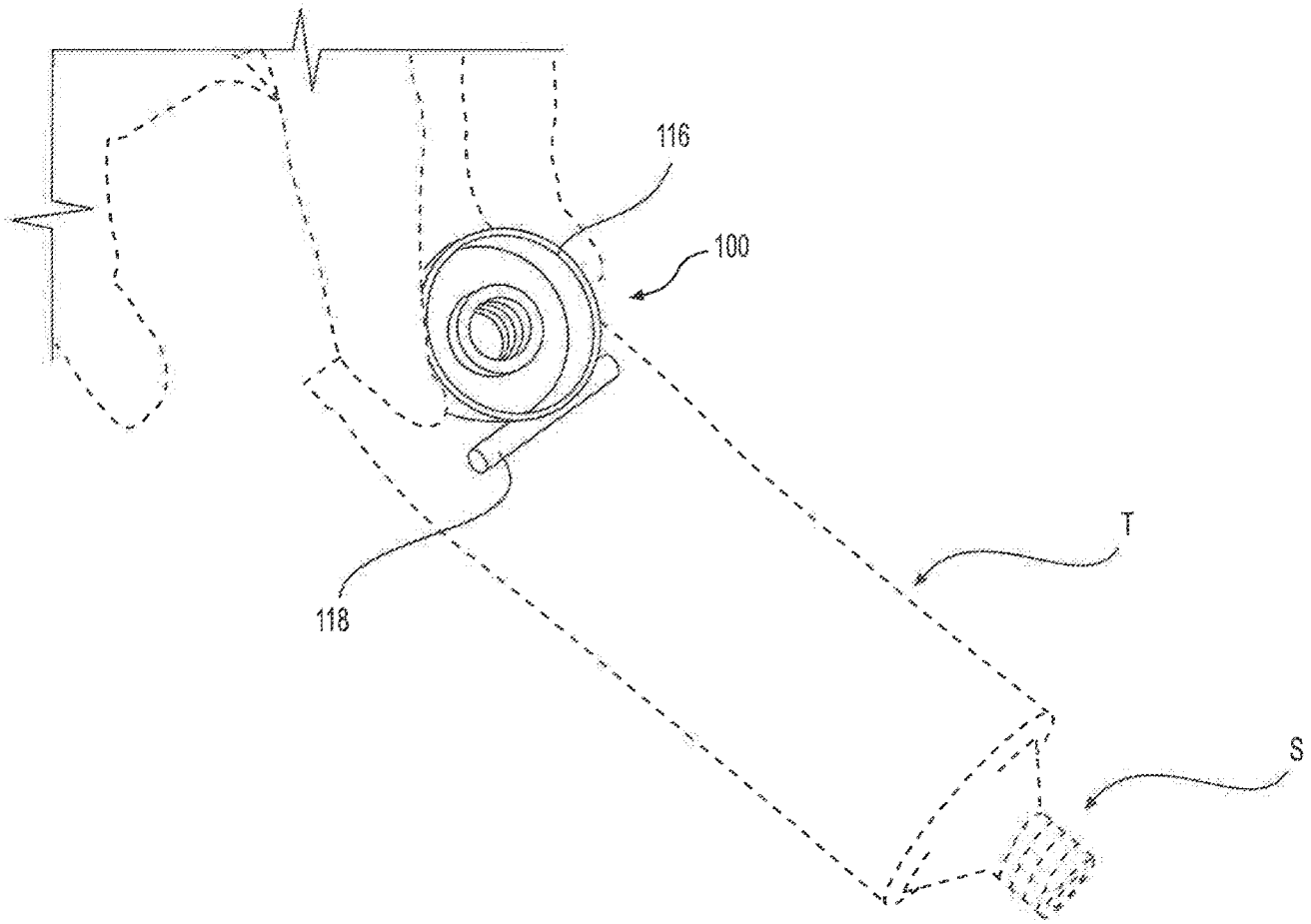
FIG. 8 is an environmental perspective view of the second embodiment of the multi-purpose cap for a tube dispenser of FIG. 5, shown being used for squeezing the contents of an exemplary tube dispenser.

As shown in FIG. 8, the squeezing member 118 is adapted for pressing against the squeezable tube dispenser T to selectively manipulate the contents thereof. Thus, when the user wishes to, for example, squeeze or push the contents of tube T towards spout S, the device 100 is removed from spout S, the user grips the sidewall 116, contacts the squeezing member 118 against an exterior of tube T, and squeezes the tube T, with squeezing member 118, pushing device 100 forward, toward spout S.

It is to be understood that the present invention is not limited to the embodiments described above, but encompasses any and all embodiments within the scope of the following claims.

I claim:

1. A multi-purpose cap for a squeezable tube dispenser, comprising:

a hollow body having a closed upper end, an open lower end and substantially cylindrical sidewall, the hollow body having a longitudinal axis extending from the lower end through the upper end;

a cylindrical retaining member mounted to a lower face of the closed upper end within said hollow body, the retaining member mounted concentrically with respect to the cylindrical sidewall; and a cylindrical squeezing member having a longitudinal center axis extending tangentially from an exterior surface of the substantially cylindrical sidewall of said hollow body and perpendicularly to the longitudinal axis of the hollow body, wherein the squeezing member is located adjacent the closed upper end of the hollow body, whereby said cylindrical retaining member is adapted for releasably receiving and sealing a spout of a squeezable tube dispenser, and the squeezing member is adapted for pressing against the squeezable tube dispenser to selectively manipulate contents thereof.

2. The multi-purpose cap for a tube dispenser as recited in claim 1, wherein the closed upper end of said hollow body has a flat planar contour.

3. The multi-purpose cap for a tube dispenser as recited in claim 1, wherein an inner face of said cylindrical retaining member is threaded.

4. The multi-purpose cap for a tube dispenser as recited in claim 1, wherein said squeezing member comprises an elongated rod.

5. A tube dispenser with a multi-purpose cap, comprising:

a squeezable tube dispenser having a spout; and a multi-purpose cap, comprising:

a hollow body having a closed upper end, an open lower end and a substantially cylindrical sidewall, the hollow body having a longitudinal axis extending from the lower end through the upper end;

a cylindrical retaining member mounted to a lower face of the closed upper end within said hollow body, the retaining member mounted concentrically with respect to the cylindrical sidewall; and a cylindrical squeezing member secured tangentially to an exterior surface of the substantially cylindrical sidewall of said hollow body and having a longitudinal center axis extending perpendicularly to the longitudinal axis of the hollow body, wherein the squeezing member is located adjacent the closed upper end of the hollow body, a length of the squeezing member being about the same as a width of the tube dispenser, whereby said cylindrical retaining member is adapted for releasably receiving and sealing the spout of the squeezable tube dispenser, and the squeezing member is adapted for pressing against the squeezable tube dispenser to selectively manipulate contents thereof.

6. The tube dispenser with an multi-purpose cap as recited in claim 5 wherein the closed upper end of said hollow body has a flat planar contour.

7. The tube dispenser with an multi-purpose cap as recited in claim 5, wherein an inner face of said cylindrical retaining member is threaded.

8. The tube dispenser with an multi-purpose cap as recited in claim 5, wherein said squeezing member comprises an elongated rod.

* * * * *